United States Patent [19]

Elsas

[11] 4,061,096

[45] Dec. 6, 1977

[54] QUILTED MATERIAL MENDING SYSTEM

[75] Inventor: Norman E. Elsas, Atlanta, Ga.

[73] Assignee: Louisville Bedding Company, Louisville, Ky.

[21] Appl. No.: 703,950

[22] Filed: July 9, 1976

[51] Int. Cl.[2] ..... D05B 11/00

[52] U.S. Cl. ..... 112/121.14; 112/118; 112/155; 112/262

[58] Field of Search ..... 112/121.14, 121.29, 112/2, 117, 118, 155, 262; 26/70

[56] References Cited

U.S. PATENT DOCUMENTS

| | | | |
|---|---|---|---|
| 1,313,012 | 8/1919 | Poetzsch | 26/70 |
| 1,608,944 | 11/1926 | Klau | 112/155 |
| 2,163,304 | 6/1939 | Corrall et al. | 112/121.14 |
| 3,371,630 | 3/1968 | Cash, Jr. | 112/121.14 |
| 3,960,095 | 6/1976 | Story | 112/118 |

FOREIGN PATENT DOCUMENTS

| | | | |
|---|---|---|---|
| 1,418,266 | 10/1965 | France | 112/155 |

*Primary Examiner*—Werner H. Schroeder

*Assistant Examiner*—Peter Nerbun

*Attorney, Agent, or Firm*—Jones, Thomas & Askew

[57] ABSTRACT

Elongated quilted webs which have line out flaws are moved from a first container at high speed in a downward direction in front of an operator, then laterally through a sewing station toward the operator, then downwardly away from the operator to a second container. When a flaw in the web is detected by the operator as the web moves at inspection speed in a downward direction toward the sewing station, the operator allows the flaw to move through the sewing station and then stops the movement of the web. The operator then reverses the direction of movement of the web so that the flaw moves back through the sewing station at sewing speed where one of several sewing machines which is closest to the flaw is energized at the sewing station and operates concurrently with the movement of the web to sew through the web. The operator moves the sewing machines in unison back and forth across the direction of movement of the web so that the sewing machine in operation can follow the path of the flaw and the proper pattern can be sewn into the quilted web.

12 Claims, 3 Drawing Figures

33
25
90
38
45
51
76
64
60
58
70
72
71
75
89
88
40
48
41
81
84
83
66
65a
65b
67
73
91
68
85
86
62
61
82
55
56
53
52
59
50

QUILTED MATERIAL MENDING SYSTEM

BACKGROUND OF THE INVENTION

When quilted bedspreads and other quilted items are manufactured, an elongated web of multi-ply material is directed along its length through a quilting machine that has a plurality of sewing machines which form stitches through the web. The sewing machines are stationary and the web is movable both longitudinally and laterally with respect to the sewing operation so that various patterns of stitching can be formed in the quilted web.

When one of the needles in the sewing heads or its bobbin runs out of thread or otherwise malfunctions, the needle from the sewing head continues to form holes in the web, but no stitching is formed. When the operator detects the absence of stitching or a "line out" in the web, the operator stops the operation of the quilting machine and rethreads the sewing machine, etc., and then reactivates the machine. The operator usually marks the flaw with an adhesive tag, etc., but the operator does not make an attempt to insert stitching in the flaw where the malfunctioning machine did not properly operate, and the holes formed in the web and the absence of stitching remain in the web as a line out flaw for subsequent mending.

The quilted web is taken from the quilting machine and cut to length. Those cut lengths which contain a line out flaw due to the absence of stitching in the quilt design are usually mended by carrying the individual quilt to a single sewing machine and having a sewing machine operator move the flawed portion of the quilt through the sewing machine to insert the stitching in the proper pattern as shown by the holes in the quilt. This procedure requires individual handling of the quilts and the sewing machine operator is required to exert a substantial amount of time and effort to position and turn the wide and long quilt at the sewing head so as to insert the stitching in the proper pattern.

SUMMARY OF THE INVENTION

Briefly described the present invention comprises a quilt mending system in which an elongated quilted web which has a line out flaw in its stitch pattern is moved progressively along its length from a supply in a downward direction in front of an operator at a high speed who inspects the web for flaws. The quilt is then turned from its downward movement and moved in a lateral direction through a sewing station toward the operator, then turned again in a downward direction and moved to a second container. When the operator detects a flaw in the web or a marker adjacent a flaw, the operator allows the flaw to move on through the sewing station, then reverses the direction of movement of the web so that it moves back through the sewing station at a slower speed and operates one of a plurality of sewing machines at the sewing station to insert the stitching in the proper quilt pattern as shown by the holes formed in the web. The sewing machines are movable in unison by the operator across the web and the operator moves the operating sewing machine as necessary during the sewing operation so that the stitches inserted in the web are formed in the proper pattern.

The quilted web is not required to move laterally but moves along its length from a first container through the system to a second container, and the sewing machines are spaced apart across the direction of movement of the quilted web so that if, for example, a flaw appears adjacent one edge of the web, a sewing machine will be in the vicinity of the flaw and the operator is required to move the sewing machine only a short distance to initially reach the flaw and the operator can then continue to guide the sewing machine to form the proper pattern of stitching in the web. If the next flaw should appear at another location across the web, for example at the opposite edge of the web, another one of the sewing machines will be positioned adjacent the flaw and can be activated without requiring the movement of a sewing machine a long distance across the web to reach the flaw.

After the quilted web has been mended, the web can be cut to length, hemmed, and otherwise finished for final packaging, shipment, etc.

Thus, it is an object of this invention to provide an improved quilt mending system which inserts missing stitching in a quilt pattern of a length of quilted web.

Another object of this invention is to provide an improved quilt mending system wherein a quilted web having stitches missing from its quilt design can be expediently and accurately mended and wherein the flaws in the quilted web can be readily detected and rapidly brought into registration with a sewing machine.

Another object of this invention is to provide an improved method and apparatus for moving a continuous web along its length through a sewing station and moving a sewing means laterally across the web for inserting stitches into the web in various designs.

Other objects, features and advantages of the present invention will become apparent upon reading the following specification, when taken in conjunction with the accompanying drawing.

DETAILED DESCRIPTION

Figure 1:
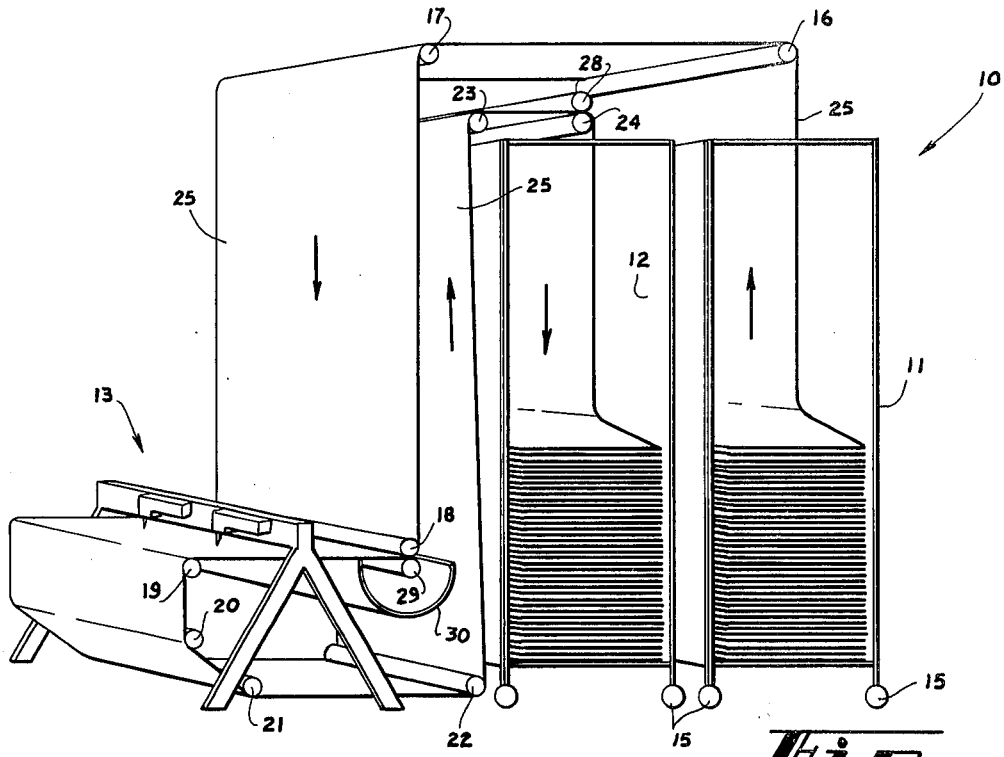
FIG. 1 is a schematic perspective illustration of the quilt mending system.

Referring now in more detail to the drawings, in which like numerals indicate like parts throughout the several views, FIG. 1 illustrates an embodiment of the quilt mending system 10 which includes a first portable container 11, a second portable container 12 and a mending apparatus 13. The containers 11 and 12 are portable in that they are mounted on caster wheels 15 and are movable on a floor surface to positions adjacent the mending apparatus 13 as illustrated. A plurality of guide rolls 16, 17, 18, 19, 20, 21, 22, 23 and 24 guide a long length or "continuous length" of quilted web 25 from container 11 through the mending apparatus 13. A driving roll 28 is urged toward engagement with guide roll 24 and is driven by an electric motor (not shown) to pull the web 25 from first container 11 through the guide rolls 16–18 to the mending apparatus 13, then about the guide rolls 19–24 to the container 12. Drive roll 29 is also urged toward engagement with guide roll 18 and is driven by an electric motor (not shown) so as to pull the quilted web 25 in the opposite direction through the mending apparatus 13 and about guide rolls 19–24 from container 12. A collection pan 30 is located beneath driving roll 29 so that the length of quilted web pulled back through the mending apparatus 13 will fall into the collection pan 30.

Figure 2:
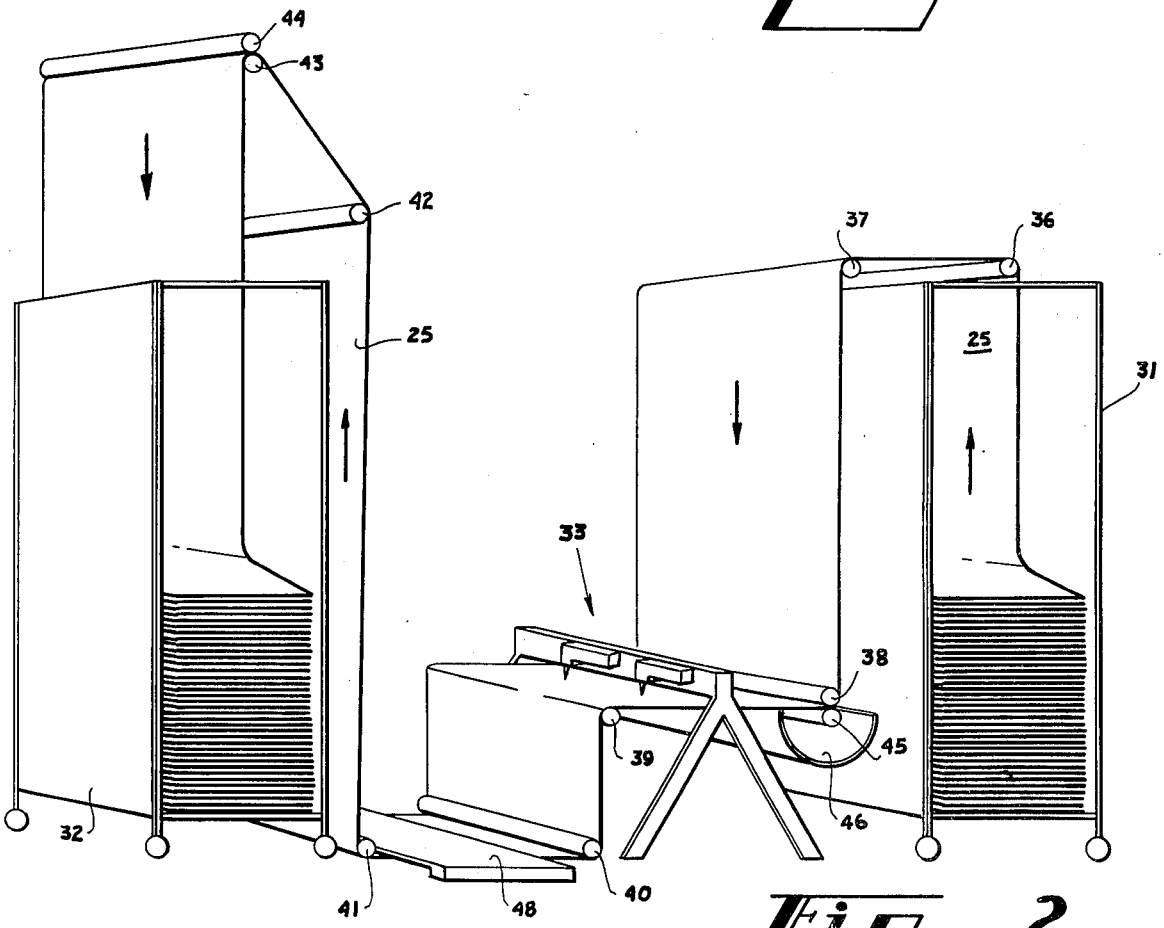
FIG. 2 is a schematic perspective illustration of a modified form of the quilt mending system.

As illustrated in FIG. 2, an alternate arrangement of the quilt mending system is available where first container 31 and second container 32 are positioned on opposite sides of a mending apparatus 33 and the quilted web 25 is moved from first container 31 into second container 32 about guide rollers 36, 37, 38, 39, 40, 41, 42 and 43. Drive rollers 44 and 45 are urged toward engagement with guide rollers 43 and 38 to pull the web in opposite directions through the mending apparatus 33, with the drive roller 44 being driven by an electric motor (not shown) to pull the web from first container 31 to second container 32 and with drive roll 45 being driven by an electric motor (not shown) to pull the web from second container 32 back through the mending apparatus 33. A collection pan 46 is located beneath drive roll 45 and collects the web pulled back through the mending apparatus 33.

An operator's platform 48 is located between guide rolls 40 and 41 adjacent the sewing station and forms an operator's station in front of the sewing station where the operator controls the inspection mending procedures. The web 25 moves beneath the operator's platform in its travel toward the second container 32.

Figure 3:
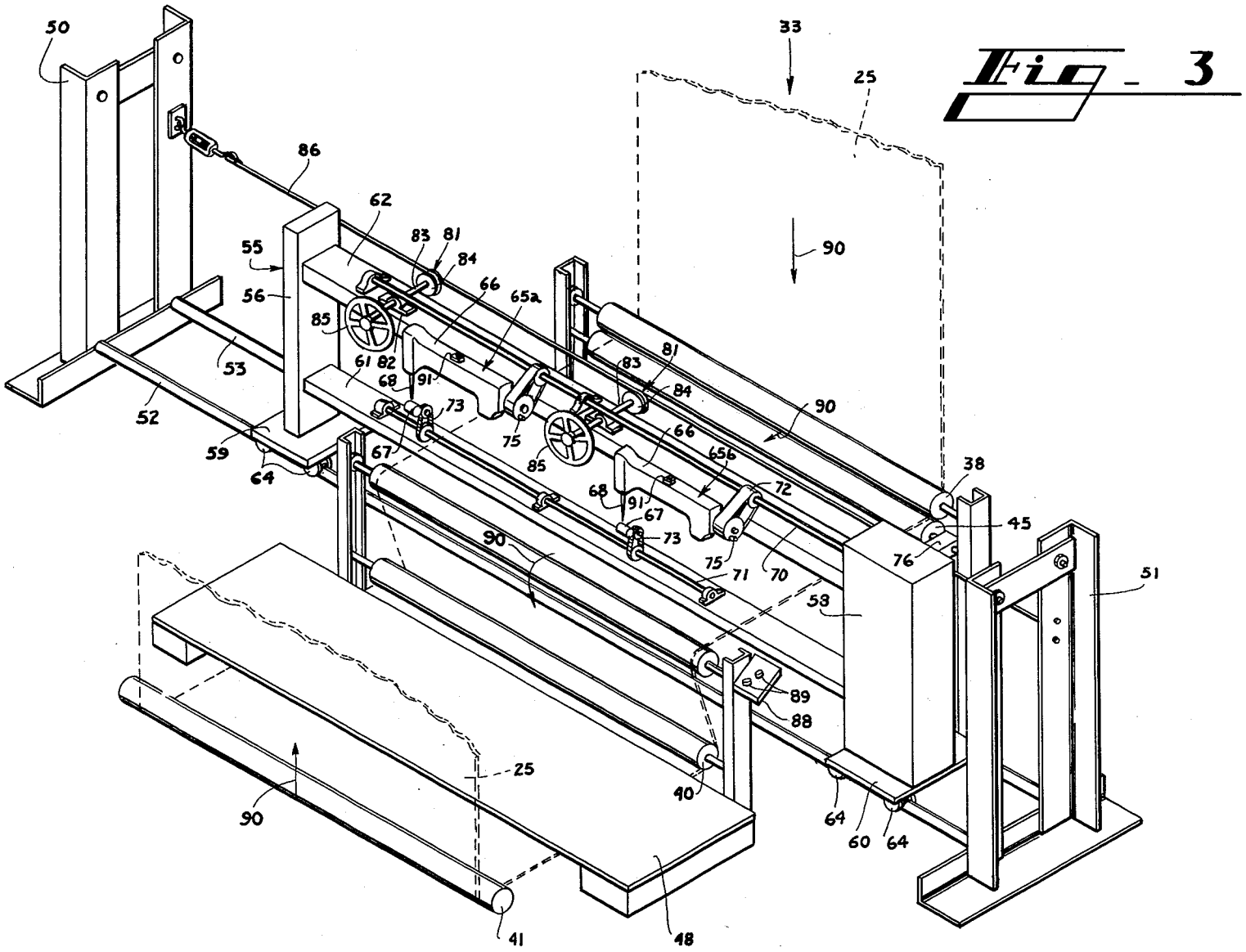
FIG. 3 is a perspective illustration of the mending apparatus which forms a part of the systems illustrated in FIGS. 1 and 2.

As illustrated in FIG. 3, the mending apparatus 33 as used in the arrangement of FIG. 2, or 13 as used in the arrangement of FIG. 1, comprises stationary end supports 50 and 51 and a pair of rectilinear bars 52 and 53 connected at their ends to the lower portions of the stationary ends supports. The rectilinear bars 52 and 53 function as track means for the mending apparatus.

Movable framework 55 is mounted on the track means 52 and 53 and comprises stanchions 56 and 58 mounted on platforms 59 and 60 and lower and upper cross supports 61 and 62 connect at their ends to the stanchions 56 and 58. The platforms 59 and 60 are mounted on wheels 64, and the wheels 64 engage the track means 52 and 53 so as to guide the movable framework 55 in a rectilinear path along the track means.

A plurality of sewing machines 65a and 65b (only two shown) are mounted on the movable framework 55, and each sewing machine comprises a sewing head 66 and a stitch locking means such as bobbin assembly 67. The sewing heads 66 are arranged with their needles 68 directed in a downward direction toward operative relationship with the stitch locking mechanism 67. An electric motor and timing belt system (not shown) are located internally of the stanchion housing 58 and function to operate sewing head drive shaft 70 and bobbin drive shaft 71 in unison. Each sewing head 66 is connected by a timing belt assembly 72 to the sewing head drive shaft and each bobbin 67 is connected by a timing belt drive assembly 73 to the bobbin drive shaft 71. The timing belt assemblies 72 for the sewing heads 66 each include a single position clutch such as pin clutch 75 which allows the sewing head to be inactive or to become active upon the rotation of the sewing head drive shaft 70 by inserting or withdrawing the pin lug 75. The pin clutch assembly causes its sewing head to be driven in timed relationship with the other sewing heads and the bobbins. Another timing belt drive system 76 is connected between the drive motor (not shown) in the stantion housing 58 and the drive roll 45 so that the drive roll 45 operates in unison with the sewing heads and the bobbins.

Guide assembly 80 comprises a plurality of winch means 81 connected to the upper cross support 62 of a movable framework 55 at spaces between sewing heads 66. A winch means is located adjacent each sewing head and each winch means comprises a bearing block 82 mounted on the upper cross support 62, shaft 83 extending through the bearing block, winch sheave 84 on one end of shaft 83 and guide wheel 85 on the other end of the shaft. Cable 86 is wound about each winch sheave 84 and is connected at its opposite ends to the stationary end supports 50. When one of the guide wheels 85 is rotated, its cable sheave 84 also rotates so that the winch means 81 tends to walk along the length of the cable 86, which causes the movable framework 55 to move along the track means 52 and 53. As one of the winch means 81 is rotated, the other winch means will be free to rotate in unison therewith. Other types of guide assemblies can be incorporated in the system, if desired, such as rack and pinion guide means or power assisted guide means, as long as the assembly functions accurately and expediently to cause the needles of the sewing machines to follow the holes of the line out in the quilted web.

An electrical control panel 88 is located adjacent the operator station and controls are provided to energize the variable speed electric motors (not shown) which rotate the drive rollers 43 and 45 (FIG. 2) or 28 or 29 (FIG. 1), to cause the web 25 to move through the mending apparatus 33. For example, when one of the controls 89 is depressed by the operator, the drive roll 43 will pull the web in the direction indicated by arrows 90 at a high rate of speed down in front of the operator where the web is inspected by the operator, then horizontally through the sewing station, and then down in front of the operator's station. The operator is able to see the entire width of the web as it moves in a downward direction from the top of the first container 31 (FIG. 2) toward the level of the sewing station even though the web is moving at high speed. When a flaw is detected in the quilted web 25, the operator allows the flaw to pass on through the sewing station until the flaw is located on the operator's side of the sewing station. The operator then stops the movement of the web 25 and moves to the sewing head which is closest to the flaw and rotates a quide wheel 85 to position the needle 68 of the sewing head at the flaw. The operator then engages the pin clutch 75 of that particular sewing head and depresses the actuating switch 91 which energizes the motor (not shown) in the stanchion housing 58 which causes the sewing head at the location of the operator and the bobbins 67 to operate and which rotates drive roll 45 through timing belt assembly 76. The mending apparatus thus pulls the web 25 back through the sewing station as the sewing head functions to insert the stitches in the flaw of the quilted web. The mending procedure is performed at normal sewing speed which is slower than the inspection speed, and as the system operates, the operator rotates the guide wheel 85 adjacent the sewing head which is in use so as to shift the movable framework 55 and all of the apparatus carried thereby laterally with respect to the direction of movement of the web 25, so that the needle 68 of the sewing machine in use follows the track of the line out flaw in the web. As the web continues to move through the sewing head during the mending operation, the web will move beyond the guide roll 38 and drive roll 45 and move in a downward direction into the collection pan 46.

When the mending operation has been completed, the operator will actuate a cutting mechanism (not shown) to cut the threads from the bobbin and sewing head, and then the operator will depress one of the control buttons 89 at the control panel 88 to resume the high speed movement of the web 25 in the directions indicated by arrows 90.

Although the particular drive motor and timing belt system for the sewing machines 65*a*, 65*b*, etc. are not illustrated, it will be understood by those skilled in the art that drive systems for sewing machines of this type are common in the art, as shown in U.S. Pat. Nos. 3,180,293, 3,426,710, and 3,442,234. Also, while two sewing machines are illustrated in this application, it will be understood that the system can be constructed with one or several sewing machines, and that the term "sewing machine" is used herein to include various other types of machines usable in the system. Moreover, while this invention has been described in detail with particular reference to preferred embodiments thereof, it will be understood that variations and modifications can be effected within the spirit and scope of the invention as described hereinbefore and as defined in the appended claims.

I claim:

1. A method of inspecting and mending an elongated quilted web comprising the steps of moving the web along its length from a container at a first speed along a path first through a downwardly extending portion of the path adjacent a sewing station so that the web can be visually inspected from the sewing station then along its length in a first lateral direction through the sewing station until a flaw in the web has moved beyond the sewing station, stopping the web movement, moving the portion of the web having the flaw in the opposite direction back through the sewing station at a second speed slower than the first speed while the portion of the web in the downwardly extending portion of the path remains stopped, sewing through the portion of the web having the flaw with one of a plurality of sewing means at the sewing station as the web is moved along its path back through the sewing station at the slower speed, and moving all of the sewing means in unison across the movement of the web during the sewing step in the mending of the web.

2. The method of claim 1 and wherein the step of moving the web along its length through a sewing station comprises moving the web in one direction from a first container on one side of the sewing station through the sewing station to a second container on the other side of the sewing station.

3. The method of claim 1 and wherein the step of moving the web along its length through a sewing station comprises moving the web from a first container on one side of the sewing station through the sewing station to a second container on the same side of the sewing station.

4. The method of claim 1 and wherein the step of moving the web along its length through a sewing station comprises pulling the web in a first direction from a supply through the sewing station and into a container until a flaw in the web has been moved through the sewing station, pulling the web in the opposite direction from the container through the sewing station to a collection area adjacent the sewing station.

5. The method of claim 1 and wherein the step of moving the sewing means across the movement of the web during the sewing step comprises moving the sewing means back and forth across the web to guide the sewing means in the path formed by the flaw in the web.

6. A product formed by the process of claim 1.

7. Apparatus for inspecting and mending elongated quilted webs or the like comprising a sewing station, means for moving a web in one direction along its length at a high speed first in a downward direction from a level higher than the sewing station toward the level of the sewing station and then laterally through said sewing station and for moving the web in the reverse direction along its length at a slower speed back through the sewing station, track means extending across the direction of movement of the web, sewing means positioned at said sewing station for sewing through the web, said sewing means comprising at least two sewing heads and stitch locking assemblies mounted on said track means, means for operating one of said sewing heads and stitch locking means in unison, and winch means connected to said sewing means for moving said sewing means along said track back and forth across the length of the web.

8. The apparatus of claim 7 and further including a first portable container and a second portable container, and wherein said means for moving a web along its length through said sewing station comprises first means for pulling the web in one direction from said first container through the sewing station to said second container, and second means for pulling the web in the opposite direction through the sewing station.

9. Apparatus for mending quilted webs or the like comprising rectilinear track means, a framework mounted on and movable along the length of said track means, means for moving said framework along said track means, and web guide means for moving a web from a supply along a path first in a downward direction so that the web can be visually inspected and then in a lateral direction through said framework at a first speed in a direction normal to the length of said track means and for moving the web in the opposite direction along the path through the framework at a second speed slower than the first speed, sewing means supported by said framework and including at least two sewing machines each comprising a sewing head located on one side of the path of the web and a stitch locking means located on the other side of the path of the web, drive means for said all of the sewing heads and stitch locking means located at the edge of the path of the web and arranged to drive said sewing heads and stitch locking means in unison.

10. The apparatus of claim 9 and wherein said means for moving said framework along said track means comprises winch means connected to said framework.

11. Apparatus for mending quilted webs or the like comprising a first container, a second container, a sewing station, an operator's station adjacent said sewing station, guide means for guiding a web from said first container at a first speed in a downward direction on one side of the sewing station, then laterally in one direction through the sewing station toward said operator's station and then to said second container and for guiding the web in the opposite direction back through the sewing station away from the operator's station, at a second speed slower than the first speed, rectilinear track means, a framework mounted on and movable along said track means, at least two sewing means mounted on said framework at said sewing station, and means for urging said framework along said rectilinear track means back and forth across the direction of movement of the web so that the sewing means move in unison across the direction of movement of the web.

12. The apparatus of claim 11 and wherein said sewing means comprises a plurality of sewing heads and a stitch locking means for each sewing head, motor means for simultaneously operating said sewing means and stitch locking means in timed relationship, and clutch means for selectively disengaging each of said sewing heads from said motor means.

* * * * *